US008658879B2

(12) United States Patent
Gillette

(10) Patent No.: US 8,658,879 B2
(45) Date of Patent: Feb. 25, 2014

(54) ACTIVE BRIDGE FOR STRINGED MUSICAL INSTRUMENTS

(76) Inventor: Stephen Gillette, Simi Valley, CA (US)

( * ) Notice: Subject to any disclaimer, the term of this patent is extended or adjusted under 35 U.S.C. 154(b) by 427 days.

(21) Appl. No.: 12/249,377

(22) Filed: Oct. 10, 2008

(65) Prior Publication Data

US 2009/0064853 A1 Mar. 12, 2009

Related U.S. Application Data

(63) Continuation-in-part of application No. 11/292,824, filed on Dec. 2, 2005, now Pat. No. 7,453,040.

(60) Provisional application No. 60/633,318, filed on Dec. 3, 2004.

(51) Int. Cl.
*G10H 3/14* (2006.01)

(52) U.S. Cl.
USPC ..... 84/723; 84/725; 84/726; 84/735

(58) Field of Classification Search
None
See application file for complete search history.

(56) References Cited

U.S. PATENT DOCUMENTS

| | | | | |
|---|---|---|---|---|
| 3,571,483 | A | 3/1971 | Davidson | |
| 3,742,113 | A | 6/1973 | Cohen | |
| 3,813,473 | A | 5/1974 | Terymendo | |
| 3,983,777 | A | 10/1976 | Bartolini | |
| 4,075,921 | A | 2/1978 | Heet | |
| 4,137,811 | A | 2/1979 | Kakehashi | |
| 4,151,368 | A | 4/1979 | Fricke et al. | |
| 4,151,776 | A | 5/1979 | Stich | |
| 4,171,661 | A | 10/1979 | Rose | |
| 4,181,058 | A | 1/1980 | Suenaga | |
| 4,236,433 | A | 12/1980 | Holland | |
| 4,245,540 | A | 1/1981 | Groupp | |
| 4,364,295 | A | 12/1982 | Stich | |
| 4,484,508 | A | 11/1984 | Nourney | |
| 4,497,236 | A | 2/1985 | Rose | |
| 4,535,668 | A | 8/1985 | Schaller | |
| 4,549,461 | A | 10/1985 | Rose | |
| 4,555,970 | A | 12/1985 | Rose | |
| 4,580,481 | A | 4/1986 | Schaller et al. | |
| 4,697,491 | A | 10/1987 | Maloney | |
| 4,702,141 | A * | 10/1987 | Bonanno | 84/626 |
| D293,117 | S | 12/1987 | Rose | |
| D293,118 | S | 12/1987 | Rose | |
| 4,852,444 | A | 8/1989 | Hoover et al. | |
| 4,873,904 | A * | 10/1989 | Norimatsu | 84/722 |
| 4,882,967 | A | 11/1989 | Rose | |
| 4,907,483 | A | 3/1990 | Rose et al. | |
| 4,967,631 | A | 11/1990 | Rose | |

(Continued)

*Primary Examiner* — Marlon Fletcher
(74) *Attorney, Agent, or Firm* — Paul D. Chancellor; Ocean Law

(57) ABSTRACT

A method of making musical sounds from a musical instrument may include amplifying musical sounds from vibrations of a vibrating element when a musical instrument is played, sensing forces between the musical instrument and the vibrating element and altering the forces applied to the vibrating element in response to the sensed forces to emulate musical sounds produced by a musical instrument having different musical characteristics, for example, to emulate an acoustic guitar. Piezoelectric material or magnetic material may be used to apply forces along one or more than one axis of vibration and may be controlled by a replaceable element and/or in response to user adjustments. The applied forces may be adjusted to control relative phase between the sensed and applied forces to avoid unwanted musical effects, such as unwanted sustained oscillation, in response to a fundamental period of the vibrations or random number generation to change the vibration waveform.

24 Claims, 15 Drawing Sheets

(56) References Cited

U.S. PATENT DOCUMENTS

| | | | | | |
|---|---|---|---|---|---|
| 4,998,960 | A | | 3/1991 | Rose et al. | |
| 5,054,361 | A | | 10/1991 | Usa | |
| 5,070,759 | A | * | 12/1991 | Hoover et al. | 84/726 |
| D324,693 | S | | 3/1992 | Rose | |
| 5,105,711 | A | | 4/1992 | Barnard | |
| 5,119,711 | A | | 6/1992 | Bell et al. | |
| 5,123,324 | A | | 6/1992 | Rose et al. | |
| 5,136,919 | A | | 8/1992 | Wolstein | |
| 5,140,884 | A | | 8/1992 | Bowden | |
| 5,189,242 | A | | 2/1993 | Usa | |
| 5,200,569 | A | | 4/1993 | Moore | |
| 5,208,421 | A | | 5/1993 | Lisle et al. | |
| 5,233,123 | A | | 8/1993 | Rose et al. | |
| 5,286,916 | A | | 2/1994 | Yamauchi | |
| 5,311,806 | A | | 5/1994 | Riboloff | |
| 5,315,060 | A | | 5/1994 | Paroutaud | |
| 5,321,201 | A | | 6/1994 | Noreen | |
| 5,449,858 | A | | 9/1995 | Nenning et al. | |
| 5,522,299 | A | | 6/1996 | Rose | |
| 5,523,526 | A | | 6/1996 | Shattil | |
| 5,537,907 | A | | 7/1996 | Rose | |
| 5,539,143 | A | | 7/1996 | Rose | |
| 5,585,588 | A | * | 12/1996 | Tumura | 84/726 |
| 5,589,653 | A | | 12/1996 | Rose | |
| 5,684,256 | A | | 11/1997 | Rose | |
| 5,689,075 | A | | 11/1997 | Rose | |
| 5,696,335 | A | | 12/1997 | Rose | |
| 5,700,965 | A | | 12/1997 | Rose | |
| 5,705,760 | A | | 1/1998 | Rose | |
| 5,717,150 | A | | 2/1998 | Rose | |
| 5,723,804 | A | * | 3/1998 | Replogle | 84/726 |
| 5,789,689 | A | * | 8/1998 | Doidic et al. | 84/603 |
| 5,877,447 | A | * | 3/1999 | Vice | 84/730 |
| 5,932,827 | A | | 8/1999 | Osborne et al. | |
| 5,945,615 | A | | 8/1999 | Rose | |
| 5,990,408 | A | | 11/1999 | Hasebe | |
| D420,694 | S | | 2/2000 | Rose | |
| 6,034,316 | A | | 3/2000 | Hoover | |
| 6,046,393 | A | | 4/2000 | Rose | |
| 6,046,397 | A | | 4/2000 | Rose | |
| 6,051,773 | A | | 4/2000 | Rose | |
| 6,111,176 | A | | 8/2000 | Rose | |
| 6,137,039 | A | | 10/2000 | Rose | |
| 6,194,645 | B1 | | 2/2001 | Rose | |
| 6,198,030 | B1 | | 3/2001 | Rose | |
| 6,208,135 | B1 | | 3/2001 | Shattil | |
| 6,392,137 | B1 | | 5/2002 | Isvan | |
| 6,610,917 | B2 | | 8/2003 | Ludwig | |
| 6,787,690 | B1 | * | 9/2004 | Celi et al. | 84/723 |
| 6,998,528 | B1 | * | 2/2006 | Limacher et al. | 84/662 |
| 7,279,631 | B2 | * | 10/2007 | Celi et al. | 84/735 |
| 7,385,135 | B2 | * | 6/2008 | Yoshino et al. | 84/738 |
| 7,453,040 | B2 | * | 11/2008 | Gillette | 84/723 |
| 2004/0187673 | A1 | * | 9/2004 | Stevenson | 84/737 |
| 2005/0045027 | A1 | * | 3/2005 | Celi et al. | 84/723 |
| 2005/0081703 | A1 | * | 4/2005 | Hoover | 84/726 |
| 2006/0117938 | A1 | * | 6/2006 | Gillette | 84/723 |
| 2007/0227344 | A1 | * | 10/2007 | Ryle et al. | 84/723 |
| 2009/0064853 | A1 | * | 3/2009 | Gillette | 84/725 |
| 2009/0223353 | A1 | * | 9/2009 | Loftus | 84/726 |
| 2010/0263521 | A1 | * | 10/2010 | Ierymenko et al. | 84/726 |
| 2010/0275761 | A1 | * | 11/2010 | Ierymenko | 84/731 |

* cited by examiner

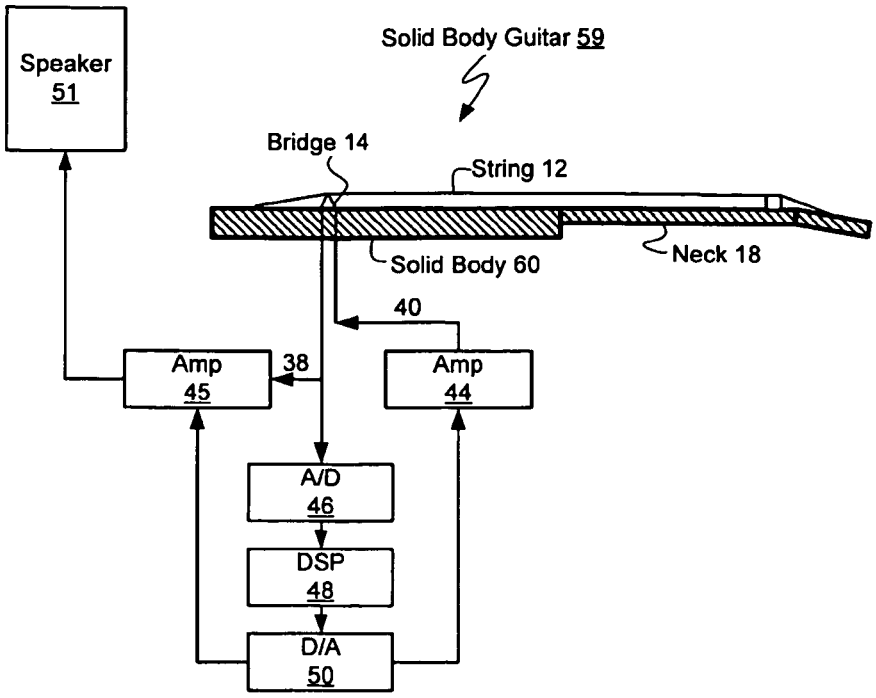
Fig. 21
Figure 22
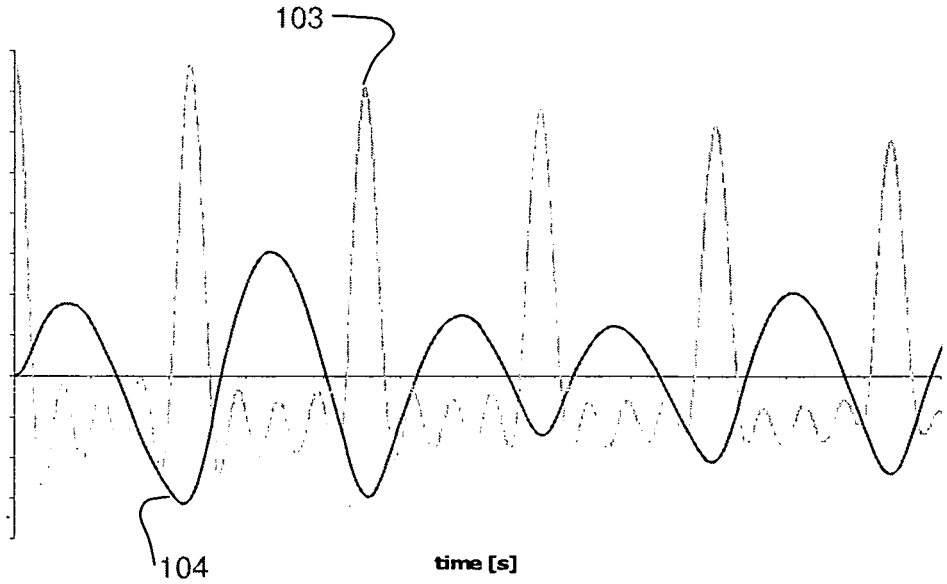

ACTIVE BRIDGE FOR STRINGED MUSICAL INSTRUMENTS

RELATED APPLICATIONS

This patent application is a continuation-in-part of U.S. patent application Ser. No. 11/292,824, filed Dec. 2, 2005, now U.S. Pat. No. 7,453,040 which claims priority of U.S. provisional patent application Ser. No. 60/633,318 filed Dec. 3, 2004.

BACKGROUND OF THE INVENTION

1. Filed of the Invention

This invention is related to musical instruments and in particular to electronically enhanced musical instruments.

2. Description of the Prior Art

Conventional electronically enhanced musical instruments use electronic pickups for detecting vibrations of musical strings (or other sound producing devices such as reeds), electronic signal conditioning circuitry responsive to the string vibrations for altering the sounds produced by the instruments in amplifiers. Conventional electronically enhanced instruments are limited in the range of effective signal conditioning which may be applied and the usefulness or convenience of such signal conditioning.

What is needed is an electronically enhanced musical instrument which has a wider range of available signal conditioning.

BRIEF DESCRIPTION OF THE DRAWINGS

FIG. 21 is a block diagram of an alternate embodiment of a solid body guitar.

FIG. 22 is a string response graph illustrating effects of the musical bridge without fixed delay.

SUMMARY OF THE INVENTION

Figure 1:
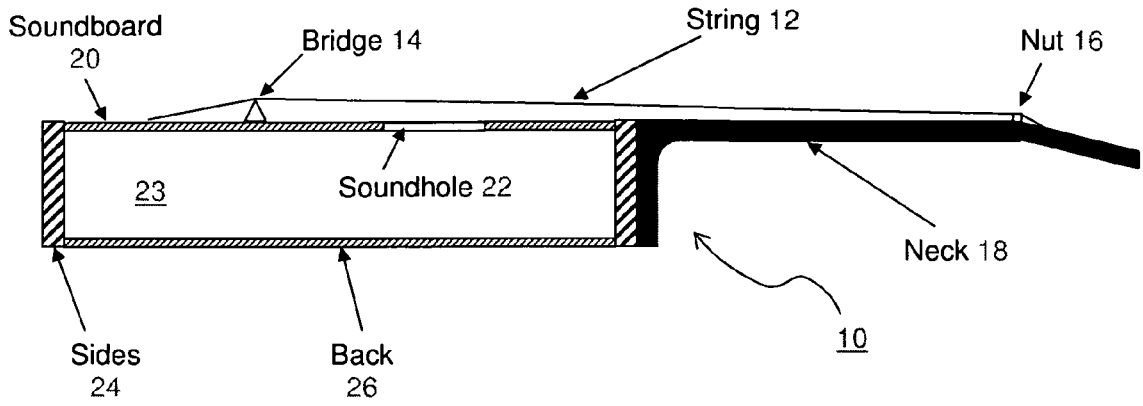
FIG. 1 is a cross sectional view of a classic string instrument, such as a guitar.

A musical instrument may include a musical instrument body, a vibrating element associated with the musical instrument body for producing musical sounds, a transducer coupled to a portion of the vibrating element to apply forces to the vibrating element, a sensor responsive to forces between the transducer and the vibrating element and a signal conditioner responsive to forces sensed by the sensor for altering the forces applied by the transducer to the vibrating element to alter the vibrations of the vibrating element.

A musical instrument may include a musical instrument body, a vibrating element, a structure supporting the vibrating element to permit vibrations, the structure coupled to the vibrating element to modify the vibrations in response to a drive signal and to produce an electrical signal related to the vibrations of the vibrating element and a signal conditioner responsive to the electrical signal for producing the drive signal to alter musical sounds produced by the vibrations.

A method of making musical sounds from a musical instrument may include amplifying musical sounds from vibrations of a vibrating element when a musical instrument is played, sensing forces between the musical instrument and the vibrating element and altering the forces applied to the vibrating element in response to the sensed forces to emulate musical sounds produced by a musical instrument having different musical characteristics, for example, to emulate an acoustic guitar.

Altering the forces may be accomplished with piezoelectric material or magnetic material. The forces may be applied along more than one axis of vibration and may be controlled by a replaceable element and/or be responsive to user adjustments during operation of the musical instrument.

Altering the forces may include controlling relative phase between the sensed and applied forces to avoid unwanted musical effects and/or delaying altering the forces in response to the sensed forces to control the emulation. The forces may be altered to avoid unwanted sustained oscillation and/or in response to a frequency characteristic of the sensed forces, such as a fundamental period of the vibrations of the vibrating element.

A characteristic of the applied forces, such as the waverform, maybe modified to reduce unwanted sustained oscillation and/or in response to a random number generation and/or in response to user input during playing of the musical instrument by the user.

DETAILED DISCLOSURE OF THE PREFERRED EMBODIMENT(S)

An active bridge is described herein for use in a musical instrument with one or more vibrating elements, such as a guitar. An electric pickup and transducer are mechanically and electrically connected so that a pickup detects vibrations from one or more vibrating strings, which are applied to a signal conditioning device, and the detected string vibration signals may be electronically altered or conditioned and applied to the transducer, which then alters the reactive force from a vibrating string thereby creating modified vibration characteristics of the string. The signal conditioning methods can emulate the physical response of traditional acoustic instruments, can provide active feedback into the string to sustain or otherwise alter the amplitude of the string vibration, can alter the natural frequency of vibration of the string, and/or provide other unique response characteristics.

In a preferred embodiment, a piezoelectric pickup and a piezoelectric transducer are mechanically coupled. The transducer has one end fixed to the body of the musical instrument and the other end attached to the piezoelectric pickup, and the piezoelectric pickup is then in direct contact with the string.

In a first aspect, an active bridge system for a musical instrument is disclosed including pickup means to sense force from a vibrating element, signal conditioning means to modify the sensed force from the vibrating element, and a transducer mechanically coupled to the instrument body and to the pickup means to accept output from the signal conditioning means and apply mechanical force to the vibrating element through the pickup means.

In another aspect, a signal conditioning transducer system is disclosed including a sensing means for converting a measurement of a mechanical system property, a signal conditioning means for modifying the sensed property of the mechanical system, and a transducer mechanically coupled to the sensing means to accept output from the signal conditioning means and apply mechanical force to said mechanical system property through the sensing means.

In another aspect, a musical instrument is disclosed having one or more vibrating elements, such as strings, at least one of the vibrating elements supported by a pickup on a bridge, a transducer supporting the bridge from the body of the instrument, and software responsive to the pickup and driving the transducer to control sound qualities.

In a still further aspect, an active bridge system for a musical instrument is disclosed including pickup means for sensing the force acting on the bridge from a vibrating element, signal conditioning means for modifying the sensed force from the vibrating element, and a transducer mechanically coupled to the instrument body to accept output from the signal conditioning means and apply mechanical force to the vibrating element.

In a still further aspect, a signal conditioning transducer system is disclosed that includes sensing means for converting a measurement of a mechanical system property, means to measure the fundamental period of said mechanical system property, a signal conditioning means for modifying the sensed property of the mechanical system, said signal conditioning means including means to delay its output so that it is synchronized with the fundamental period of the mechanical system, and a transducer mechanically coupled to the sensing means to accept output from the signal conditioning means and apply mechanical force to said mechanical system property.

In a further aspect, a signal conditioning transducer system is disclosed that includes sensing means for converting a measurement of a mechanical system property, a signal conditioning means for modifying the sensed property of the mechanical system, said signal conditioning means including means to randomly adjust the output signal, and a transducer mechanically coupled to the sensing means to accept output from the signal conditioning means and apply mechanical force to said mechanical system property.

In a further aspect, a signal conditioning transducer system is disclosed that includes sensing means for converting a measurement of a mechanical system property, a signal conditioning means for modifying the sensed property of the mechanical system, and multiple transducers mechanically coupled to the sensing means to accept output from the signal conditioning means and apply mechanical forces to said mechanical system property.

Referring now to FIG. 1, acoustic guitar 10 includes strings 12 stretched across bridge 14, described below in greater detail, and extending to a fastener such as nut 16 on the end of neck 18. Bridge 14 directs force from strings 12 to the top surface, soundboard 20 of guitar 10. Soundboard 20 vibrates in response to the forces applied by the strings 12 and converts the vibrations of strings 12 into audible sound pressure waves. Motion of soundboard 20 produces audible sound directly from its own vibration, as well as from the resonance of the air within chamber 23 within the body of guitar 10. The audible sounds produced in chamber 23 are released through sound hole 22. Sides 24 and neck 18 are relatively heavy and stiff compared to sound board 20, and together with back 26 typically do not normally transmit vibration especially because back 26 is often held in contact with the performer.

Figure 2:
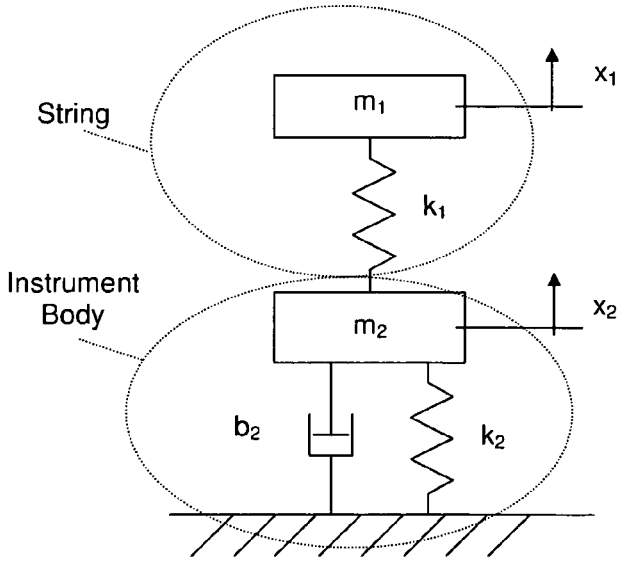
FIG. 2 is a schematic drawing of the forces applied to and by the bridge shown in FIG. 1.

Referring now to FIG. 2, a simple mechanical model of such a stringed instrument is shown. The mass $m_1$ and spring $k_1$ represent the mass and spring characteristics of a typical instrument string. The natural frequency of the string vibration is represented by the simple equation:

$$f_1 = \left(\frac{k_1}{m_1}\right)^{1/2}$$

If the end of the spring $k_1$ were to be fixed to an infinite mass, and there were no other forces acting on the string mass, the string would continue to vibrate un-attenuated at the natural frequency. This case would be approximated if the string was attached to a large steel block and vibrated in a vacuum. In a musical instrument, the string is vibrating in atmosphere, so some of the movement of the mass $m_1$ is attenuated by interaction with air molecules. However, this interaction with air molecules is not the primary source of sound emanating from the instrument. In an acoustic guitar, the forces from the string acting on the bridge cause vibration of portions of the instrument body, as discussed above with reference to FIG. 1, which extracts energy from the string vibration converting it into motion of portions of the instrument body and ultimately vibration of air molecules which becomes the characteristic sound of the instrument. In simple form, this effect of the acoustic instrument body is modeled in FIG. 2 as mass $m_2$, spring $k_2$, and viscous damping $b_2$. It is the viscous damping $b_2$ that emulates the energy transfer from the string vibration into air pressure waves, and causes the amplitude of vibration of the string to diminish over time.

Figure 3:
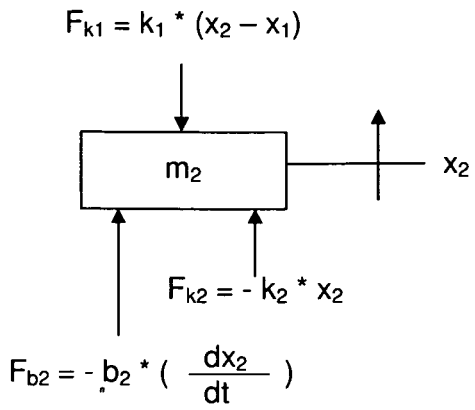
FIG. 3 is a free body diagram of a mass representing the bridge and soundboard shown in FIG. 1.

Referring now to FIG. 3, a free body diagram is shown of a mass $m_2$, which represents the bridge 14 and top soundboard 20 shown in FIG. 1. The sum of the forces applied to the mass $m_2$ acts to accelerate the mass, and thus change position $x_2$ and velocity $dx_2/dt$ over time. This can be represented by the differential equations:

$$\underset{m_2}{\Sigma F} = -F_{k1} + F_{b2} + F_{k2} = \frac{d^2 x_2}{dt^2}$$

or rearranging;

$$\underset{m_2}{-F_{k1}} = \frac{d^2 x_2}{dt^2} + b_2 \frac{dx_2}{dt} + k_2 x_2$$

Note that $F_{k1}$ is the force exerted by strings 12 onto the bridge 14. This force is dependent on positions $x_1$ and $x_2$.

Figure 4:
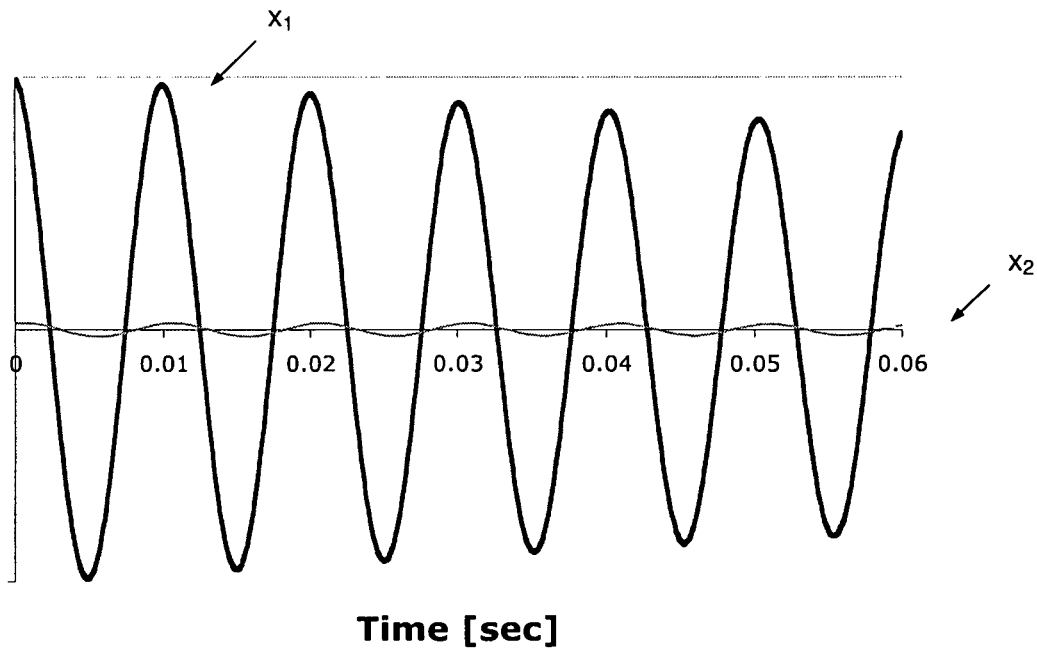
FIG. 4 is a string response graph for a simple model of a musical instrument string.

Referring now to FIG. 4, a graph of $x_1$, the position of $m_1$ and $x_2$, the position of $m_2$, vary over time at a particular frequency for a given set of values.

Of course, a real musical instrument is much more complex than this simple model. There are multiple natural frequencies of the string itself, and the body of the instrument also has multiple natural frequencies and effective damping characteristics. Master instrument builders have perfected the art of selecting construction materials, dimensions, and physical arrangements to produce their unique performance characteristics. Unfortunately, these same acoustic response characteristics that transform string vibration into airwaves become a source of feedback when amplifying the sound using traditional pickups or microphones.

Figure 5:
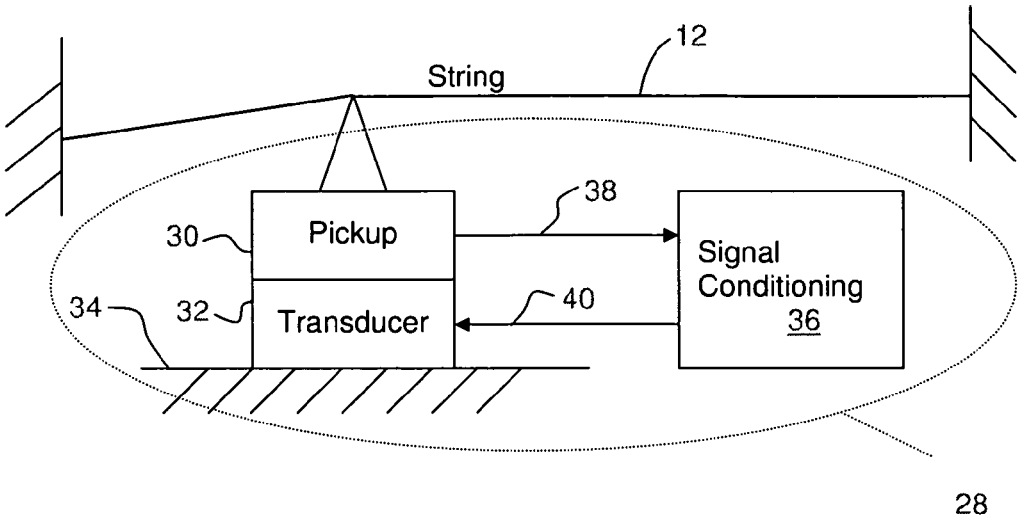
FIG. 5 is a block diagram of a pickup and transducer interacting with a vibrating musical string and its interconnections with signal conditioning circuitry.

Referring now to FIG. 5, in one embodiment one or more strings may be stretched across the top of musical bridge assembly 28 which includes piezoelectric pickup 30 supporting string 12 at one end and mounted on piezoelectric transducer 32 on the other end. The piezoelectric transducer 32 is mounted to solid body 34 of a musical instrument such as a guitar, shown as a mechanical ground in the figure. Signal conditioning circuitry 36 is provided to use pickup signal output 38 to drive transducer 32 via conditioning signal 40, as will be described in more detail below.

Figure 6:
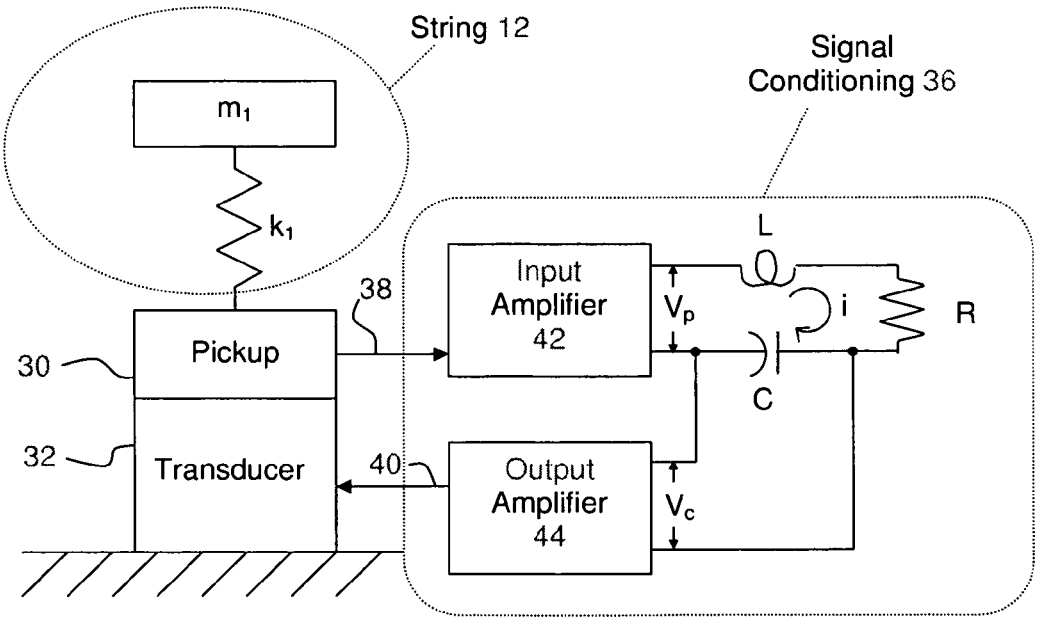
FIG. 6 is a more detailed diagram of the system shown in FIG. 5.

Referring now to FIG. 6, one implementation of musical bridge assembly 28 is shown. Pickup signal output 38 from piezoelectric pickup 30 is proportional to the force exerted by string 12 onto musical bridge assembly 28, which is analogous to the spring force $F_{k1}$ in FIG. 3. Spring force $F_{k1}$ is proportional to the distance $x_1$ minus $x_2$. This force alternates as string 12 vibrates, causing pickup signal output 38 of the piezoelectric pickup 30 to move in a likewise fashion and provide a real time indication of the force acting on the string 12 at its support on musical bridge assembly 28.

Pickup signal output 38 from piezoelectric pickup 30 is fed to input amplifier 42 to create voltage output Vp, which is also a real time indication of the oscillating spring force $F_{k1}$ acting on musical bridge assembly 28. Voltage Vp is used to drive current i in the circuit containing inductance L, resistance R, and capacitance C. The resulting voltage Vc across capacitor C is then connected to a high-impedance input of output amplifier 44 so that the voltage Vc is not impacted by the presence of output amplifier 44. The output of output amplifier 44 is conditioning signal 40 which drives piezoelectric transducer 32. The differential equation representing the LRC circuit is similar to the mechanical model described above, and can be written:

$$V_p = L\frac{d^2 q}{dt^2} + R\frac{dq}{dt} + Cq$$

Note that the charge q is analogous to the position $x_2$ above. Similarly L relates to $m_2$, R relates to $b_2$, and C relates to $k_2$. The voltage across the capacitor $V_c$, applied to the high impedance input of output amplifier 44 in FIG. 6 is therefore proportional to the position $x_2$ where the string 12 connects to musical bridge assembly 28.

The equation for the piezoelectric transducer stack, such as piezoelectric transducer 32, being driven by a voltage is simply:

$$x_2 = DV_t$$

where D is a constant for a given piezoelectric stack and $V_t$ is the voltage of conditioning signal 40 output from output amplifier 44. This describes the resulting position output $x_2$ for an unconstrained piezoelectric stack. By choosing a stack that is able to produce high force levels compared to the string force $F_{k1}$, this simple linear relationship is a good approximation. The result is that the mechanical system of an acoustic instrument can be emulated using the electric circuit components in FIG. 6 to provide the same response characteristics to string vibration.

As shown in FIG. 6, the vibration of the string 12 is sensed and can be output to traditional sound amplification in a variety of ways; such as using traditional electromagnetic pickups, using the piezoelectric pickup output $V_p$, using the voltage drop across the resistor R in FIG. 6 (which may be analogous to the sound emanating from an acoustic instrument), or blending of these signals. Similarly, electromagnetic or piezoelectric or other transducers may be applied to other vibrating elements of the musical instrument.

Figure 7:
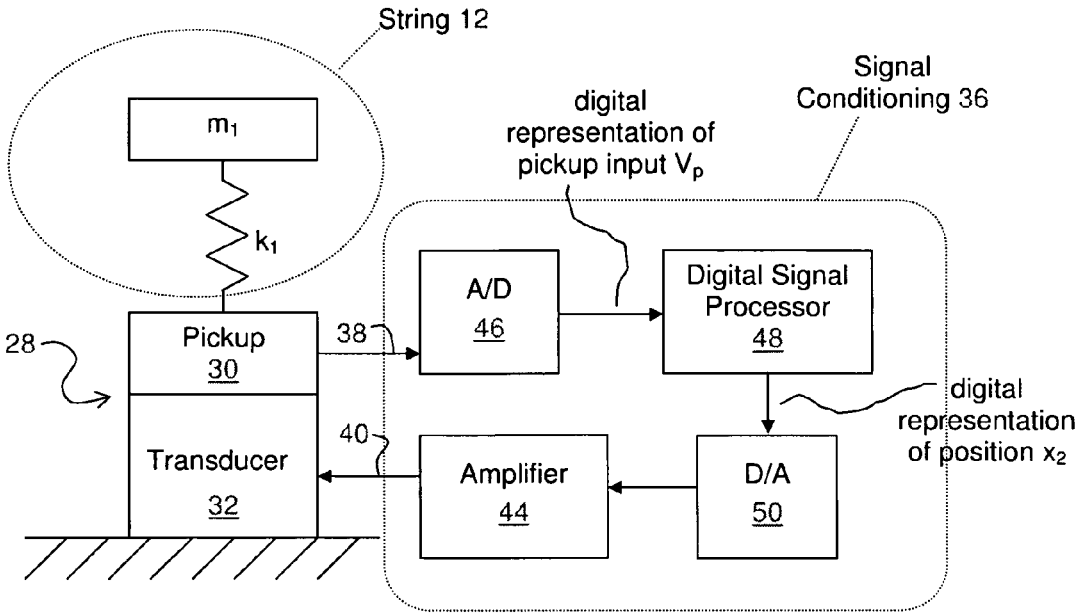
FIG. 7 is a diagram of a digital version of the signal conditioning circuitry shown in FIGS. 5 and 6.

Referring now to FIG. 7, pickup signal output 38 is applied to analog to digital (A/D) converter 46, the output of which is applied as digital samples to digital signal processor 48 which may emulate the response of the mass $m_2$, spring $k_2$, and damping $b_2$ shown in FIG. 2. The output of digital signal processor 48 is converted to an analog signal by digital to analog (D/A) converter 50, the output of which represents position $x_2$ and is applied to the input of output amplifier 44 which is then used to drive piezoelectric transducer 32. The result is the same as for the simple model with damping shown in FIG. 4. The values for $m_2$, $k_2$, and $b_2$ can be controlled by the performer to provide different string response characteristics; either as preset values and/or as real time values changed during playing of the instrument.

More complex models can be incorporated in the software to achieve different performance characteristics. For example, a conventional musical instrument may include one or more primary vibrating elements such as strings or reeds which are primarily directly excited by the musician as well as responsive vibrating elements, such as sound boards, which vibrate in response to the vibration of the primary vibrating elements. Models of the musical instrument may include models of the response of responsive vibrating elements to vibrations of the primary vibrating elements. In this way, for example, a guitar without a substantially responsive vibrating element, such as a solid body electric guitar, may be made to sound like a guitar with a responsive vibrating element, such as an acoustic guitar with a sound board, by causing the primary vibrating elements to emulate the combined vibrations of the strings and sounding board, as described in greater detail below with regard to FIG. 10. In an alternate embodiment, the output of amplifier 44 may be used directly, with a suitable sound producing device such as a speaker, to reproduce the sound of an acoustic guitar.

Alternately, the pickup element may respond to the vibrations sensed by a secondary vibrating element, such as a sounding board, caused by an outside source such as another musical instrument. In this way, the vibrations of an outside source may be detected, applied to the signal conditioner and canceled by the signals applied to strings.

Figure 8:
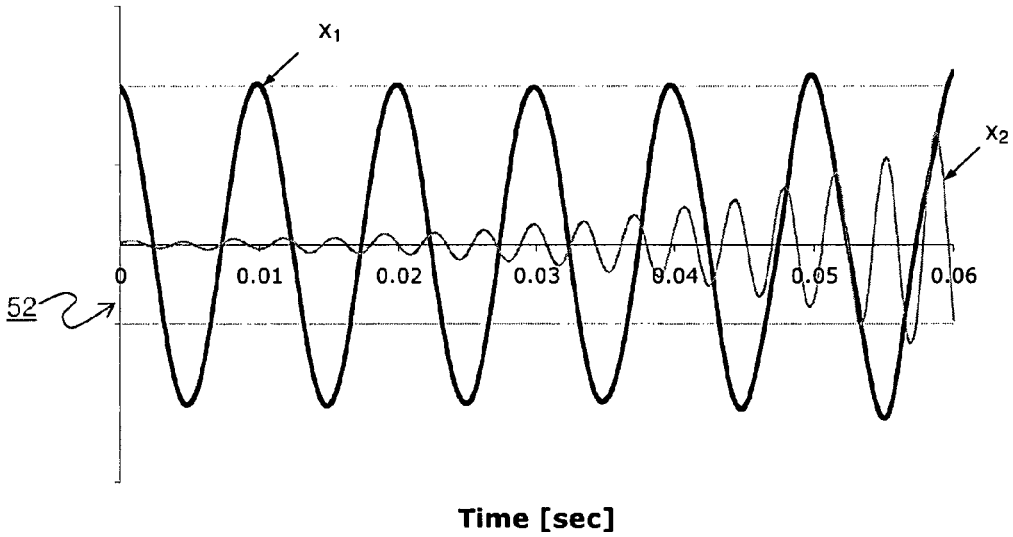
FIG. 8 is a string response graph illustrating dampening and enhancing effects of the musical bridge.

Referring now to FIG. 8, musical bridge assembly 28 is able to add energy to or remove energy from the vibrations of string 12. Musical bridge assembly 28 can create sustained string vibration by, for example, using a negative value for the damping coefficient $b_2$ shown in FIG. 2. String response 52 illustrates the effect of a negative value of $b_2$ in which the amplitude of vibration of string 12 increases. The value for $b_2$ can be adjusted to increase vibration (as in the example), to provide only enough energy back into the string to overcome other damping effects to achieve unlimited sustain, or to provide any desired envelope of string vibration amplitude. The value of $b_2$ can be preset, can be manually adjusted during playing of the instrument, or can be automatically controlled as part of the signal conditioning. For example, the value of $b_2$ can be controlled by the level of signal output from piezoelectric pickup 30 to provide a predetermined amplitude envelope over time. This can be used to achieve a tremolo effect, where string vibration amplitude is adjusted up and down over a preset cycle time. Other feedback control schemes can also be utilized.

Musical bridge assembly 28 may also be used to adjust the frequency of the string vibration. This may be accomplished by driving piezoelectric pickup 30 with piezoelectric transducer 32 to provide a step response with or against the force exerted by string 12. If pickup signal output 38 goes above a preset level, signal conditioning circuit 36 can send a step output in conditioning signal 40 to piezoelectric transducer 32. If this step output interferes with the force exerted by the string 12 on the bridge assembly 28, the effect is to increase the frequency of vibration of string 12. If the step output is synchronized with the force on the bridge assembly 28 caused by the vibration of string 12, the effect is to decrease the frequency. The amplitude of the step determines the amount of frequency shift from the natural frequency of the vibration of string 12.

Figure 9:
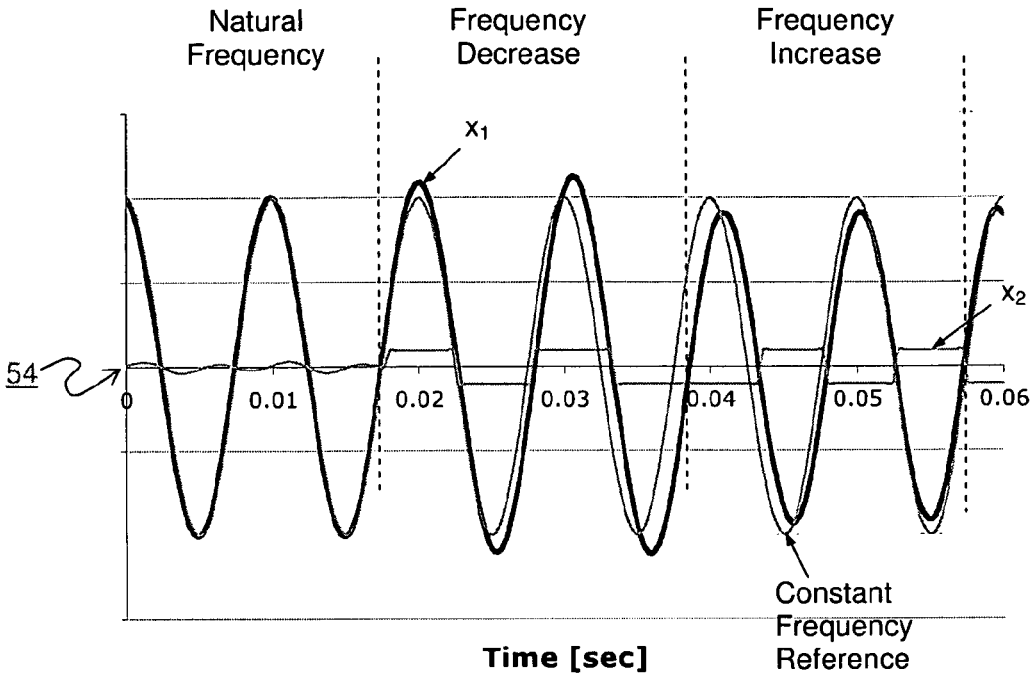
FIG. 9 is a string response graph illustrating frequency chance effects provided by the musical bridge.

Referring now to FIG. 9, string response 54 provides an example with two cycles at natural frequency, followed by two cycles at lower frequency, followed by two cycles at higher frequency to illustrate the ability of musical bridge assembly 28 to control the frequency of the vibration of string 12. Note how quickly the frequency responds to the step output from musical bridge system string response 54. This feature can be used as an adjustment controlled during playing of a musical instrument (such as is traditionally done using a vibrato tailpiece that mechanically controls the tension of the string), or can be used to adjust pitch to compensate for non-linearity in the playing characteristics of the musical instrument.

Figure 10:
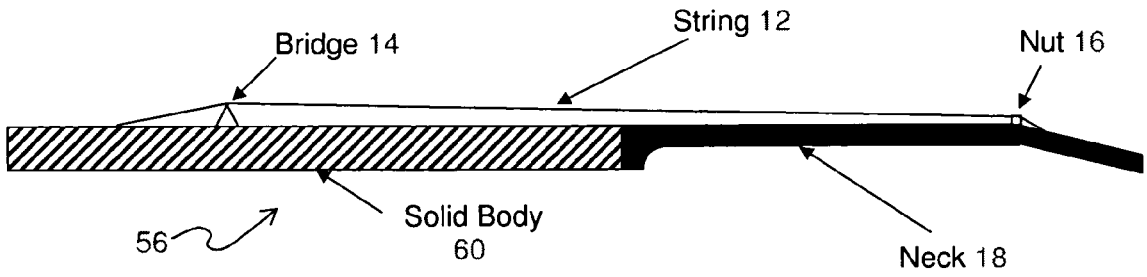
FIG. 10 is a cross sectional view of a solid body musical instrument such as an electric guitar.

Referring now to FIG. 10, a cross section for a solid body electric guitar musical instrument 56 is shown which includes solid body 60, bridge 14, string 12, nut 16 and neck 18. Solid body guitars, such as instrument 56 are not designed to produce strong interaction between the body and the strings. This characteristic is also modeled using the mechanical system in FIG. 2. In this case, $m_2$ and $k_2$ are much larger than for the acoustic instrument, and $b_2$ is smaller. Therefore, the response characteristics of solid body guitars can also be modeled by changing the L, R, and C values shown in FIG. 6, or the numerical integration constants used in the digital signal processor 48 shown in FIG. 7. Musical bridge assembly 28 can be used to cause an instrument, such as instrument 56, to emulate the sounds of a fine acoustic instrument, and then with a change in settings can immediately emulate the response of a solid body guitar providing the performer with a large range of capabilities.

Other configurations of musical bridge system 28 can provide additional functionality. In the simple configuration of FIG. 5, bridge assembly 28 interacts with the string 12 in only one plane of motion. However the mass $m_1$ shown in FIG. 2 is not constrained to move only in the x direction.

Figure 11:
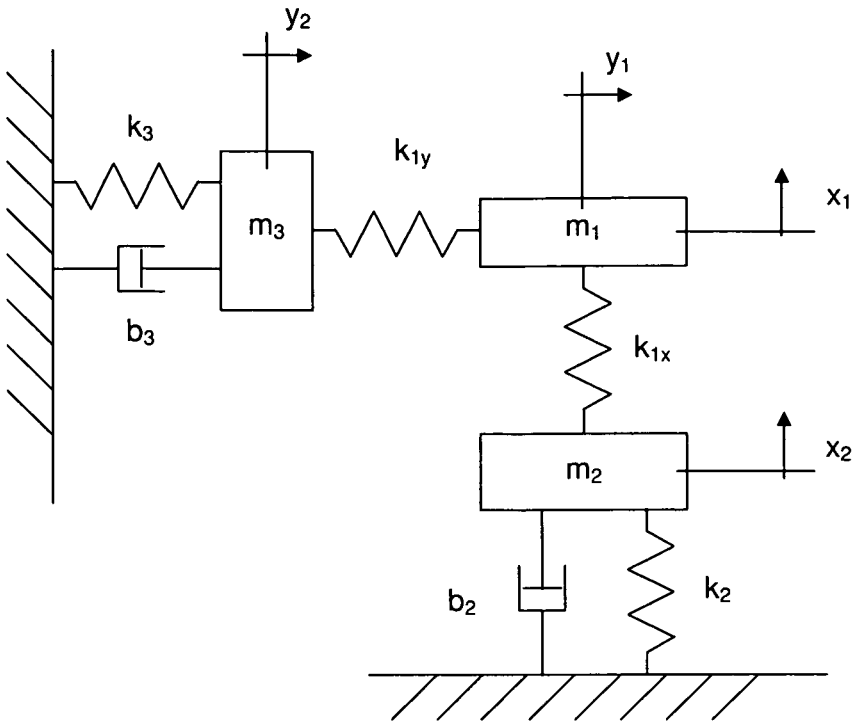
FIG. 11 is a schematic drawing of the forces applied to and by the bridge shown in FIG. 12.

Referring now to FIG. 11, a more detailed model of vibrating string 12 and bridge system 28 is shown in which string 12 is represented by mass $m_1$ and springs $k_{1x}$ and $k_{1y}$. Similarly, bridge system 28 is represented by two systems with corresponding mass, spring, and damping constants $m_2$, $m_3$, $k_2$, $k_3$, $b_2$, and $b_3$.

Figure 12:
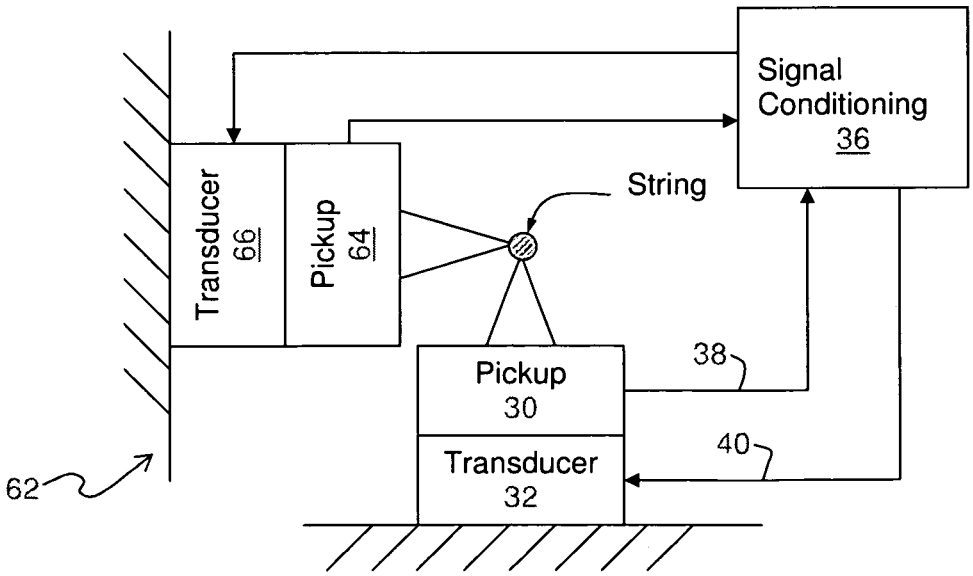
FIG. 12 is a diagram of a bridge system using a pair of transducer/pickup string support systems applied at right angles to a vibrating string.

Referring now to FIG. 12, musical bridge system 62 is illustrated including piezoelectric pickup 30 providing pickup signal output 38 to signal conditioning circuitry 36 and piezoelectric transducer 32 receiving conditioning signal 40 from conditioning circuitry 36 generally in the manner shown in FIG. 5. In addition, an additional set of pickups and transducers, piezoelectric pickup 64 and piezoelectric transducer 66 are shown mounted in a different orientation, in this example, in a horizontal orientation at right angles to the orientation of pickup 30 and transducer 32. FIG. 12 is an end view taken across a cross section of string 12 which may be supported by both pickup/transducer assemblies. Signal conditioning provided by signal conditioner 36 can be separate for each combination of pickup and transducer, or can be cross-coupled to achieve different response characteristics. For example, it may be desirable to maintain vibration in one plane. In this case, signals from one pickup, such as pickup 30, can be used to provide a damping effect in transducer 32 while creating a sustaining effect in transducer 66.

Figure 13:
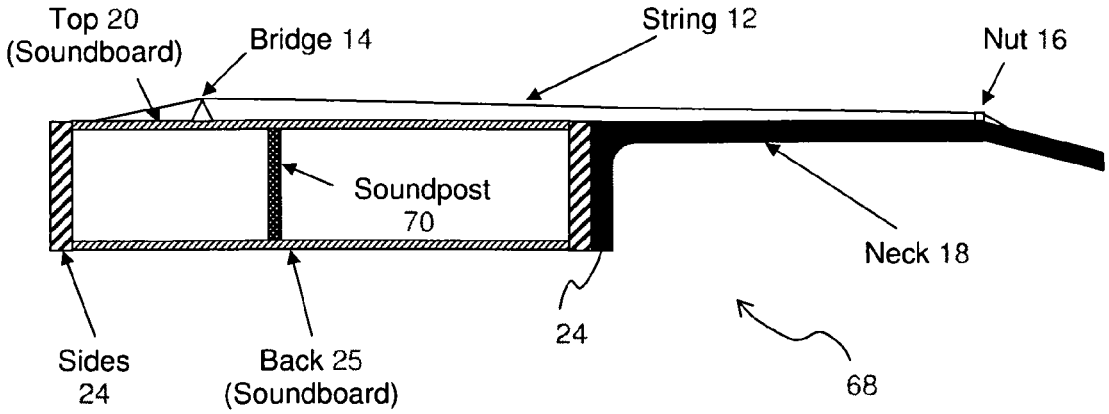
FIG. 13 is a cross sectional view of a musical instrument with a sound post, such as a violin.

Referring now to FIG. 13, a cross section of acoustic instrument 68 is shown, including string or strings 12, bridge 14, nut 16, neck 18, top soundboard 20 and sides 24 as shown in FIG. 1. Also shown is back 25, which acts as a soundboard in this configuration, coupled by sound post 70 to top soundboard 20. Signal conditioning used with this configuration, which may be a traditional violin, for example, may provide extreme flexibility in creating unique sound response characteristics.

Figure 14:
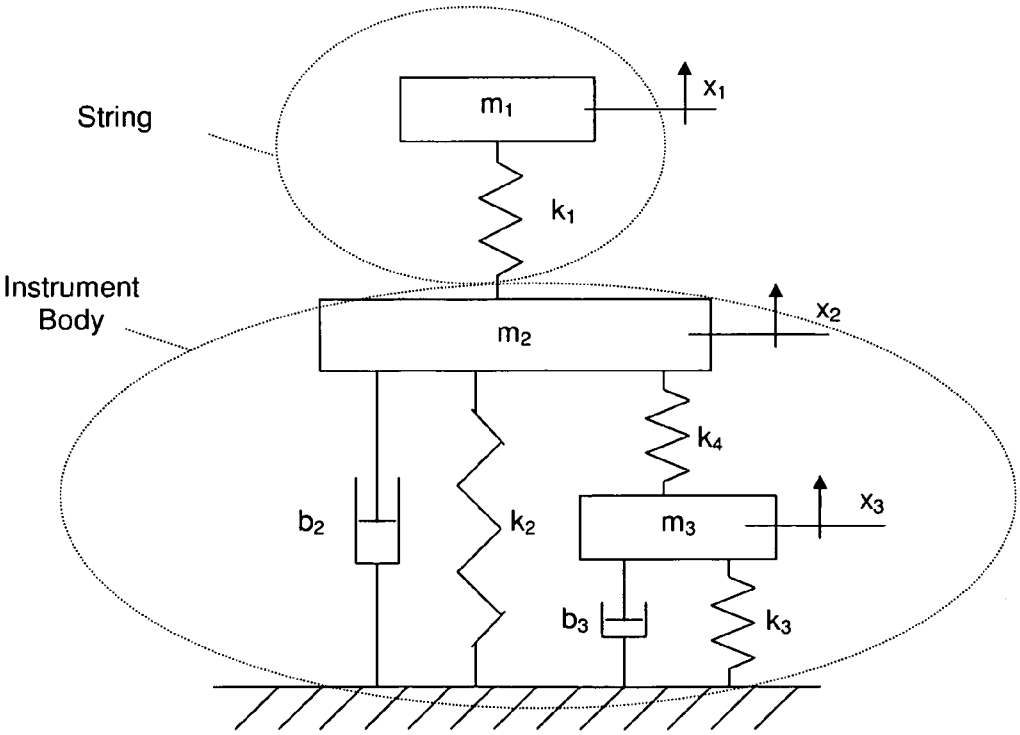
FIG. 14 is a force diagram of the instrument shown in FIG. 13.

Referring now to FIG. 14, a mechanical model for the acoustic instrument of FIG. 13 is shown. The mass $m_3$ has been added to represent the effective mass of back soundboard 25 with its own effective spring constant $k_3$ and acoustic damping effect $b_3$. The spring $k_4$ resents the sound post 70, and would typically be much stiffer than either $k_2$ or $k_3$. The signal conditioning circuits of FIG. 6 or 7 may be used to emulate the acoustic instrument depicted in FIGS. 13 and 14. The desired playing characteristic of different models can be stored as preset software in signal conditioner 36. In addition, a portion of the program memory for digital signal processor 48 can be made available for third parties, for example as a replaceable element, to create their own models and response characteristics for an instrument, thereby further opening up the possibilities for creating unique performance attributes.

The response characteristics of the signal conditioner may be changed by replacing the replaceable element.

Figure 15:
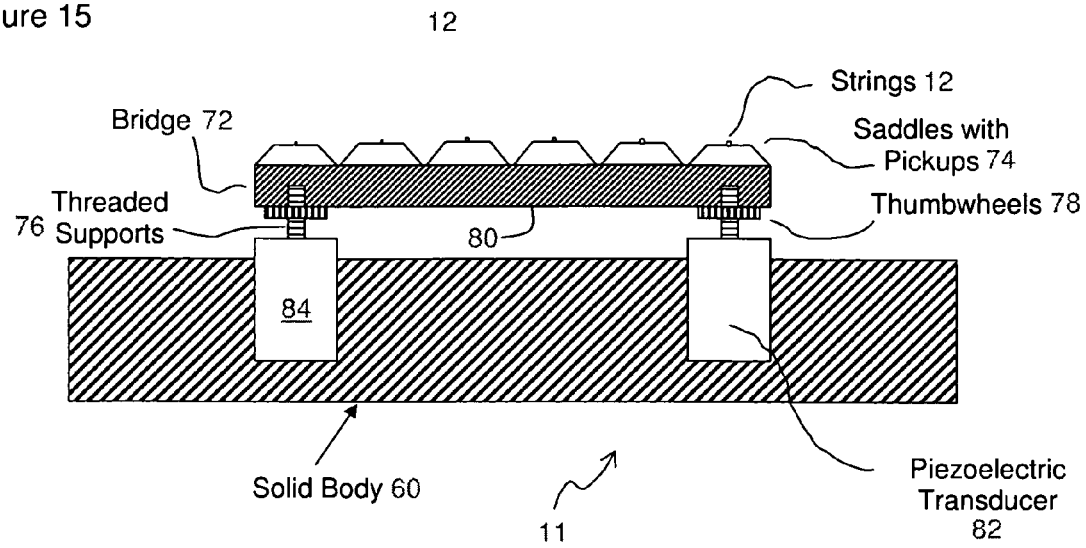
FIG. 15 is a cross sectional view of a musical bridge in a traditional configuration.

Referring now to FIG. 15, instrument musical bridge assembly 72 may be used as bridge 14 in FIGS. 1, 10 and 13. FIG. 15 shows a cross section of a traditional bridge design for musical bridge assembly 72 in which strings 12, shown in cross section, are each supported by adjustable saddles 74 with integral piezoelectric pickups, operating in the same general manner as pickup 30 shown in FIGS. 6 and 7, to sense the force of each individual string 12. Each saddle 74 and its integral pickup may be separated mounted for isolation on bar 80.

Bridge assembly 72 includes traditional threaded supports 76 with thumbwheels 78 to adjust the height (or action) of the strings 12. Normally, these threaded supports 76 are held firmly in place so that the string forces on bridge assembly 72 are transmitted to the top of the instrument, such as the top of solid body 60. Each threaded support 76 is connected to one of the piezoelectric transducer supports 82 and 84, which may be cylindrical transducers assemblies, and may be supported by recesses in the solid body 60. The voltage signals (such as pickup signal output 38 shown in FIGS. 5, 6 and 7) from each of the piezoelectric pickups 74 are applied to a multi-channel version of signal conditioning system 36 (such as signal conditioning system 36 shown in FIGS. 5, 6 and 7), with multiple outputs (such as a series of conditioning signals 40 shown in FIGS. 5, 6 and 7) each sent to one of the piezoelectric transducer supports 82 or 84.

A variety of signal conditioning options may be used with instrument 11. The simplest is to blend the signals from each pickup 74 into a single pickup signal output 38 applied to the signal conditioner in FIG. 6 or 7. The signal conditioning output 40 can likewise be a single voltage fed to both transducers in FIG. 15. Additional functionality can be gained by having each of the individual pickup signals 38 conditioned and modeled separately, and/or by using separate signal conditioning outputs 40 for each transducer 82 and 84. For example, transducer 82 under the heavier strings could be sent lower frequency signals than the transducer 84 under the lighter strings. This will accentuate the differences in natural frequencies, creating more pure tones at both ends of the frequency spectrum. Likewise, the individual string inputs could each have their own signal conditioning circuits or numerical integration software. This will allow the performer to select how each string should respond. For example, the top three lighter strings could be set to react like an acoustic instrument, and the bottom three bass strings could be set to respond as if they were connected to a solid body instrument.

The simple construction of instrument 11 shown in FIG. 15 may easily be retrofit into existing solid body guitars. For example, the existing bridge assembly can be removed, two recesses for the transducers 82 and 84 can be bored into the instrument body, and the new bridge assembly 72 inserted as shown in FIG. 15. The electronics for the signal conditioning can be mounted to the back of the solid body, or into new recesses to maintain the original instrument thickness.

Figure 16:
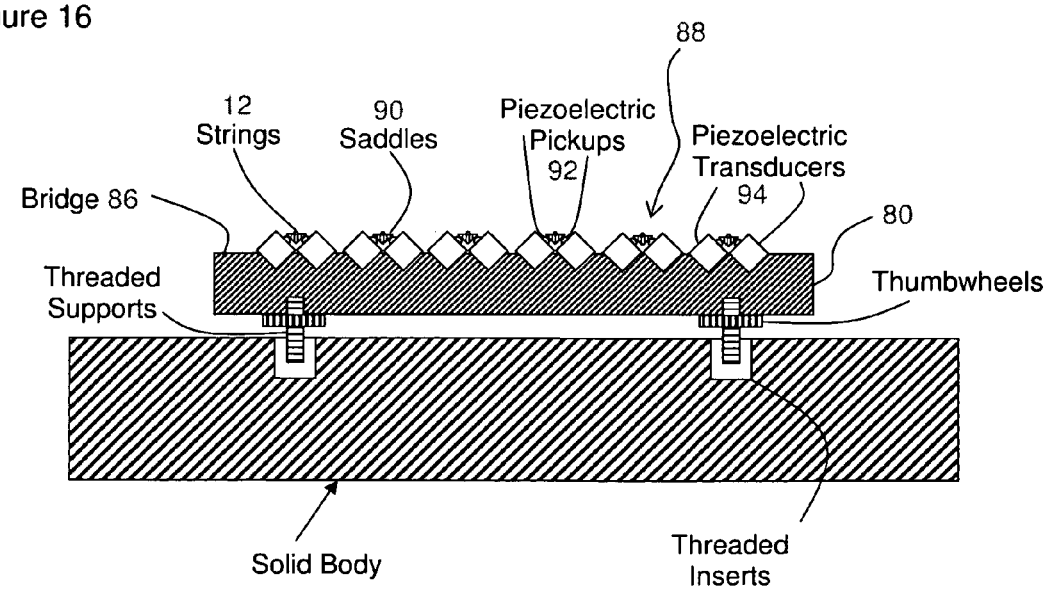
FIG. 16 is a cross sectional view of an alternate configuration of the bridge shown in FIG. 15.
Figure 17:
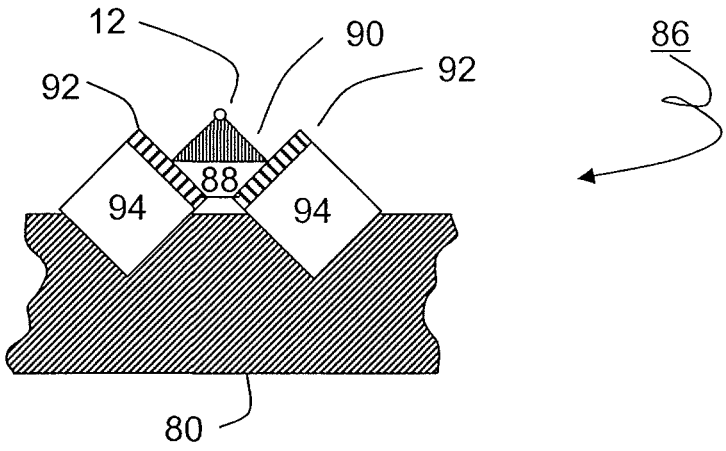
FIG. 17 is a more detailed cross section view of the support for a single string of the bridge shown in FIG. 16.

Referring now to FIGS. 16 and 17, an alternate physical configuration is shown for bridge 86 in which integrated pickup and transducer assemblies 88 are provided for each string 12. Each string saddle 90 has a generally triangular cross section and contacts string 12 at a groove in the top of the saddle. Each saddle 90 is supported by a pair of piezoelectric pickups 92 typically at a 45-degree angle from perpendicular. Each pickup 92 is supported by a piezoelectric transducer 94. The saddles 90 are able to move up and down as well as side to side, depending on the combined displacements of the two transducers 94. Each triangular saddle 90 extends perpendicular to the figure, and is supported in a manner similar to traditional saddles to provide for adjustment of intonation (for example using screw adjustment to move the string contact point of saddle 90 either closer to or further away from nut 16, shown in FIG. 1). Transducers may be cylindrical, and held in place by recesses in the bar 80 in which they are supported. Signals from each of the two string pickups 92 are input to individual signal conditioning circuits, such as signal conditioning circuits 36 shown in FIGS. 5, 6 and 7. Likewise, each of the two string transducers 92 receives its own signal conditioning output 40. This bridge assembly 86 is then able to act as shown in FIG. 12, with each string 12 having its own unique response characteristic. Note that it is also now possible to eliminate or accentuate the interaction between strings 12 by properly configuring signal conditioner 36. Another advantage of the configuration in FIGS. 16 and 17 is that retrofit to existing solid body or even acoustic instruments may be easier than for the bridge assembly in FIG. 15. Only the existing bridge assembly needs to be replaced, and suitable location for the signal conditioning electronics provided.

Figure 18:
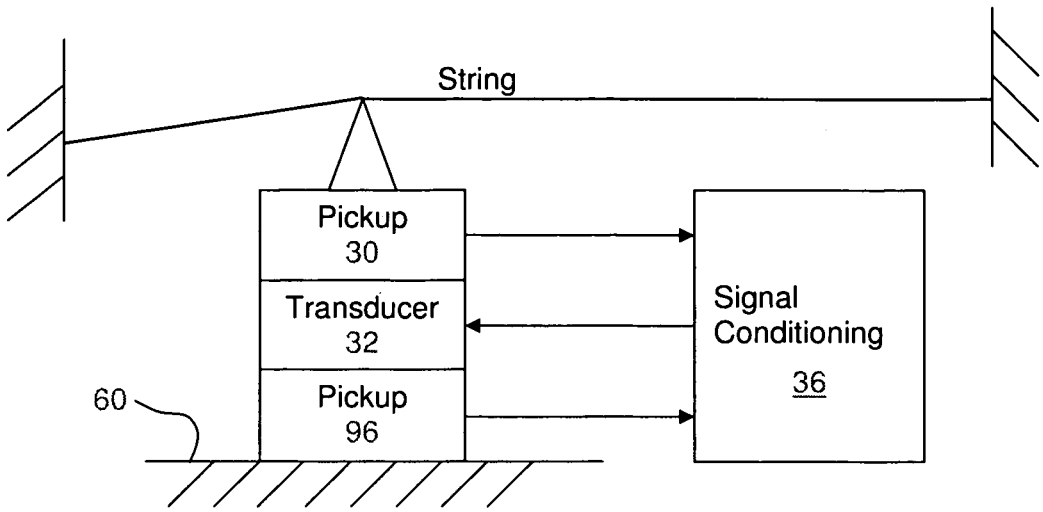
FIG. 18 is a diagram of a bridge system using an additional pickup between the transducer and body.

Referring now to FIG. 18, a second piezoelectric pickup 96 may be mechanically attached between piezoelectric transducer 32 which supports pickup 30 and mechanical ground, such as solid body 60. This configuration can sense vibrations from the mechanical connection to the instrument body between transducer 32 and body 60, and provide appropriate feedback via signal conditioning 40 to transducer 32 to accentuate or retard the impact of vibration of the instrument body 60 on the string 12. This permits a traditional acoustic instrument to be played with high amplification without undesirable and uncontrolled feedback.

Figure 19:
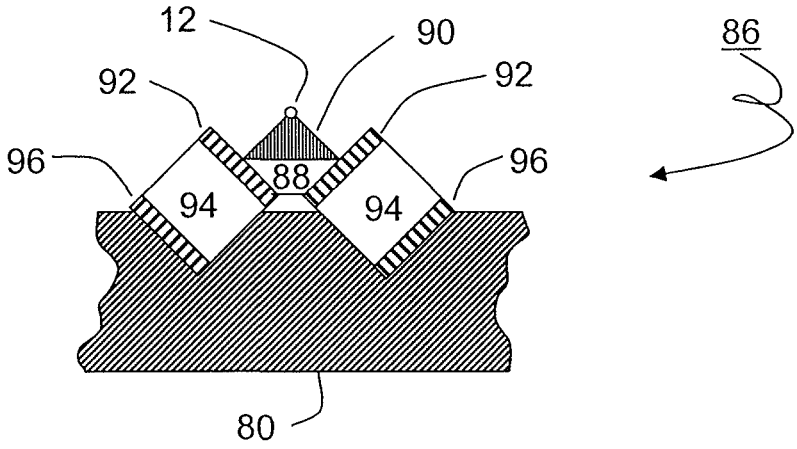
FIG. 19 is a cross section view of an alternate configuration of the string support shown in FIG. 17 in which an additional pickup is provided between the transducer and its support.

Referring now to FIG. 19, an alternate configuration of bridge 86 is shown in which each transducer 94 is supported by a second pickup 96 and isolated from other contact with body 80. By appropriately programming signal condition 36 as discussed above with regard to FIG. 18, interaction between strings 12 may be reduced, eliminated or accentuated.

Figure 20:
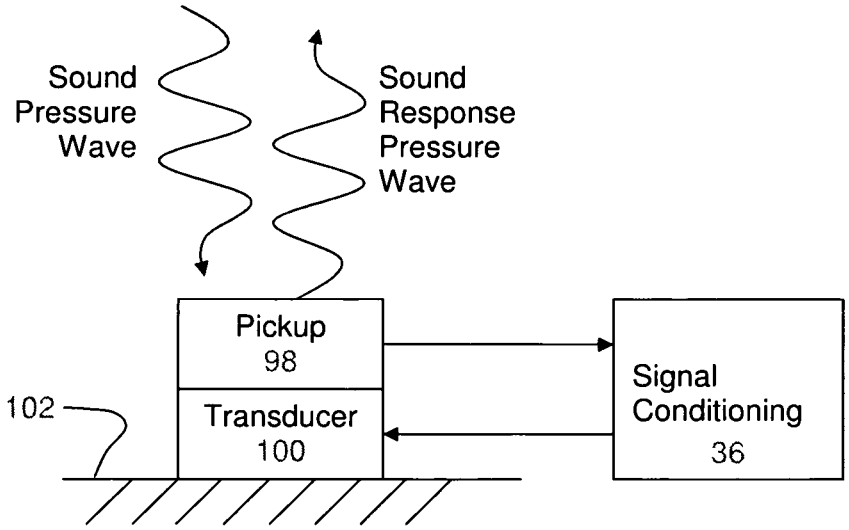
FIG. 20 is a schematic diagram of a pickup, transducer and signal conditioner used without a vibrating string.

Referring now to FIG. 20, while the above descriptions explain how an active musical bridge system can be applied to a musical instrument such as a guitar, the same assembly can be used for other purposes. The active bridge system can be used as a signal conditioning transducer assembly, to adjust the response to a variety of signal measurement situations. For example, piezoelectric pickup 98 measures sound pressure on one side, and via signal conditioner 36 provides a force to the piezoelectric transducer 100 back through pickup 98 to increase or decrease the sound pressure amplitude. Alternately, the force from the transducer may be applied to structure 102, such as a wall between rooms, to modify the sound pressure applied to the structure for example to provide sound proofing.

Referring now to FIG. 21, and to FIGS. 8 and 10, an alternate embodiment of a musical instrument such as solid body guitar 59 may include bridge 14, including at least a pickup element. Pickup output 38 may be applied to amplifier 45 so that speaker 51 may produce music related to the vibrations of string 12. Pickup output 38 may also be applied to A/D converter 46, DSP 48 and D/A converter 50. D/A converter 50 may include a model of the reaction of a secondary vibration element, for example the sound board of an acoustic guitar such as sound board 20 of FIG. 1, to the vibration of string 20. The output of D/A converter representing the vibration of sound board 20 may then be applied to amplifier 45 so that the music produced by speaker 51 would simulate the sound of an acoustic guitar.

In a further embodiment, the same or a different output of D/A 50 may also be applied to amplifier 44 the output of which may be applied as transducer input 40 to bridge 14 which in this embodiment would include a suitable transducer. DSP 48 may include an additional model, such as a model producing reverberation, so that solid body 59 may be used to simulate an acoustic guitar while including additional musical features.

Referring now to FIG. 22, an alternate embodiment is disclosed in which the fundamental time period of the vibration of string 12 is determined so that the transducer output can be applied in phase with the string vibration. Referring now also to FIG. 6, the analog signal processing applies conditioning signal 40 from output amplifier 44 is produced almost instantaneously so that the forces applied to string 12 by transducer 32 are in phase with the forces applied to string 12 by plucking. However, referring now also to FIG. 7, digital signal processing circuit first requires analog-to-digital signal conversion, then calculations are performed in the digital domain to provide the desired response, and finally re-conversion of the desired response signal from digital-to-analog is required to provide a feedback signal to the transducer. Each of these steps occupies a fixed number of clock cycles of the digital signal processor, with most of these steps being related to conversions to and from the digital domain. This means that the force finally applied to string 12 by transducer 32 will not necessarily be in the correct phase relationship with the string's fundamental vibration period.

In FIG. 22, curve 103 represents the force from plucked string 12 where it contacts the top of the musical bridge assembly 28 in an analog feedback system as shown in FIG. 6. Curve 104 represents the position of the top of musical bridge assembly 28 in the same system, resulting from transducer 32 being driven by conditioning signal 40 at the output of signal conditioning circuit 36. String 12 is modeled in curve 103 as having four natural frequencies; the fundamental and the first three harmonics. The response to the force from string 12 begins almost as soon as string 12 is plucked, as indicated by curves 103 and 104 at the beginning of the time plot. Interaction between the string vibration and the motion of the musical bridge assembly causes the characteristics of each fundamental period to change.

Figure 23:
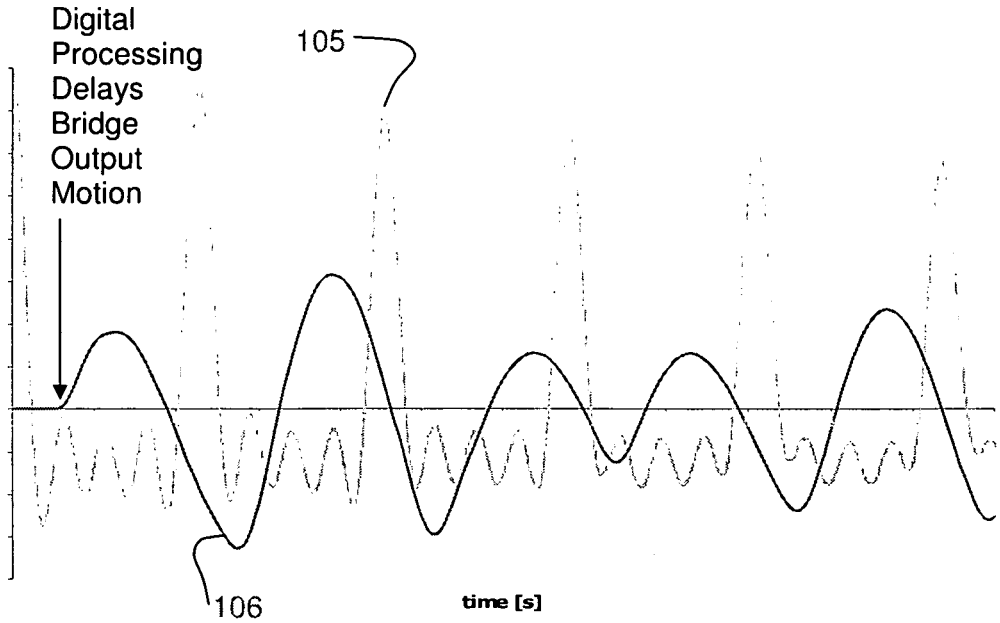
FIG. 23 is a string response graph illustrating effects of the musical bridge with fixed delay.

Referring now to FIG. 23, curve 105 represents the same initial conditions for the force from string 12 acting on musical bridge assembly 28 as shown in FIG. 22 in a digital processing circuit as shown for example in FIG. 7. However, depending on the particular frequencies used. the delay in signal conditioning circuit 36 may represent about one quarter of a cycle of the fundamental period of vibration of string 12, as can be seen in the delayed bridge output of curve 106. This fixed delay may result in undesired musical effects which may, of course, be different at different sound frequencies or notes.

Figure 24:
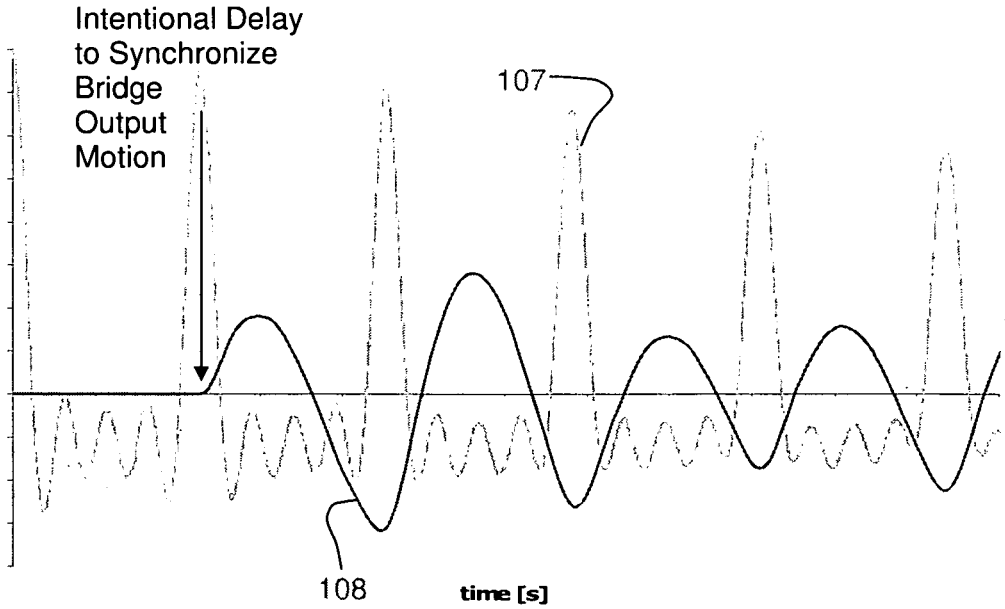
FIG. 24 is a string response graph illustrating effects of the musical bridge including an intentional delay.

Referring now FIG. 24, the fundamental time period of the vibration of string 12 can be measured, and used to calculate an appropriate time delay that, when added to the fixed time delay of the digital signal processing circuit, will put the resulting transducer output signal in phase with the string vibration signal. Referring now also to FIG. 7 again, digital signal processor 48 may include a time delay that resynchronizes the output to transducer 32 so that the motion of bridge assembly 28 caused by transducer 32 occurs a full cycle later than the initial motion of string 12. Curve 107 represents the force from string 12 acting on the top of musical bridge assembly 28, and curve 108 represents the position of the top of assembly 28 in response to conditioning signal applied to transducer 32. Techniques for measuring the fundamental period of string 12 vibration are well known in the art, and include such techniques as fast Fourier transform processing and zero crossing detection. Such techniques may be applied externally or be included within digital signal processor 48.

Digital signal processor 48 may then be used to create a synchronizing delay, based on the measured or determined fundamental frequency of string 12 so that the feedback forces applied by transducer 32 are applied synchronously, that is, as the beginning of the next fundamental period. For example, digital signal processor 48 may delay then subtracts the fixed delay associated with the digital processing network from the determined fundamental period to calculate a sync time delay. Conditioning signal 40 may then be delayed in accordance with the sync time delay, e.g. by buffering, so that the conditioning signals are applied in sync with the plucked vibration, for example, at the beginning of the subsequent fundamental period.

Figure 25:
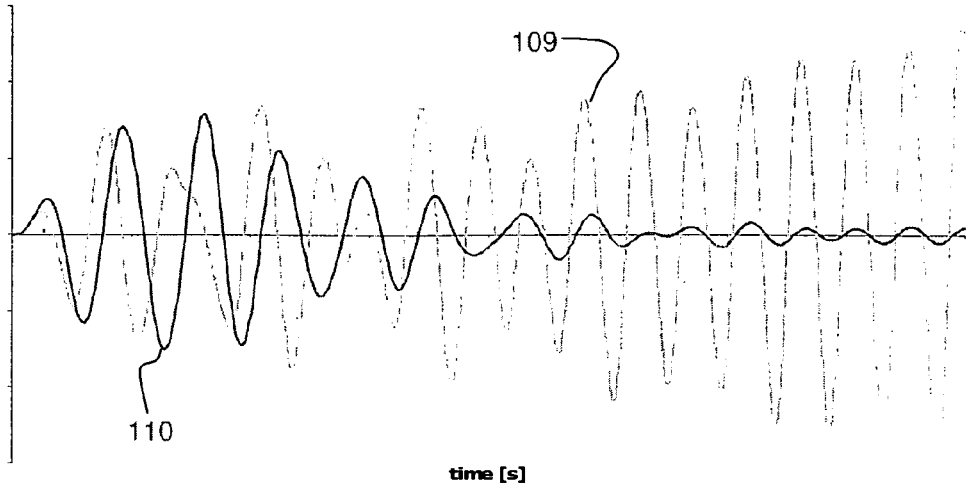
FIG. 25 is a graph comparing the differences between the string responses shown in FIGS. 22, 23, and 23.

Referring now to FIG. 25, the benefit of synchronizing the output of transducer 32 to the vibration of the plucked string 12 can be seen by comparing error curve 109 with reduced error curve 110.

Uncompensated error curve 109 was calculated by subtracting the feedback forces applied by transducer 32 to musical instrument bridge motion 28 in an analog system, represented by curve 104 in FIG. 22, from the uncompensated digital feedback forces represented by curve 106 in FIG. 23. The subtraction was done with an offset in time so that both curves start at magnitude zero. This compares the shape of the curves without regard to when they started, and is a way to quantify the difference between a system that includes some fixed delay in the signal conditioning, e.g. curve 106, with one that has no delay, e.g. curve 104. This can also be thought of as a comparison of a system with a delay error, e.g. curve 106, with the more ideal case of system without a delay, e.g. curve 104 which represent a desired sound from a real instrument such as an acoustic guitar.

Compensated error curve 110 is similarly calculated by subtracting curve 104 from the motion represented by curve 108 in FIG. 24, where the delay has been deliberately adjusted to synchronize the feedback forces with the beginning of the next fundamental period of the vibration of string 12. Note that the errors represented by both curves 109 and 110 are similar during the transient time of the first five cycles of vibration immediately after plucking string 12. However, the error represented by curve 110 for the intentional one cycle delay quickly approaches zero, while the error represented by curve 109 for the fixed digital delay may continue to increase.

In other words, the digital system of FIG. 7 may introduce an undesired delay between the plucked vibrations of string 12 which, a few cycles after the plucking has stopped, may result in an undesired enhancement of the plucked signal as the phases of the plucked and feedback signals begin to line up. In particular, musical bridge assembly 28 may add energy to string 12 to sustain vibration indefinitely. This continuous feedback circuit will ultimately result in a repetitive oscillation of the string that is a result of the specific calculations done in digital signal processor 48, as well as the physical characteristics of pickup 30 and transducer 32. This repetitive string oscillation may have a machine-like quality to the human ear, which can be perceived as unpleasant or artificial.

It is therefore desirable to avoid conditions which cause the unwanted repetitive or sustained oscillation caused by the fixed time delay of a digital feedback system. One approach may be to inject some level of random or non-machine-like calculations into the signal processing to eliminate the exact duplication of string vibrations from one period to the next.

Figure 26:
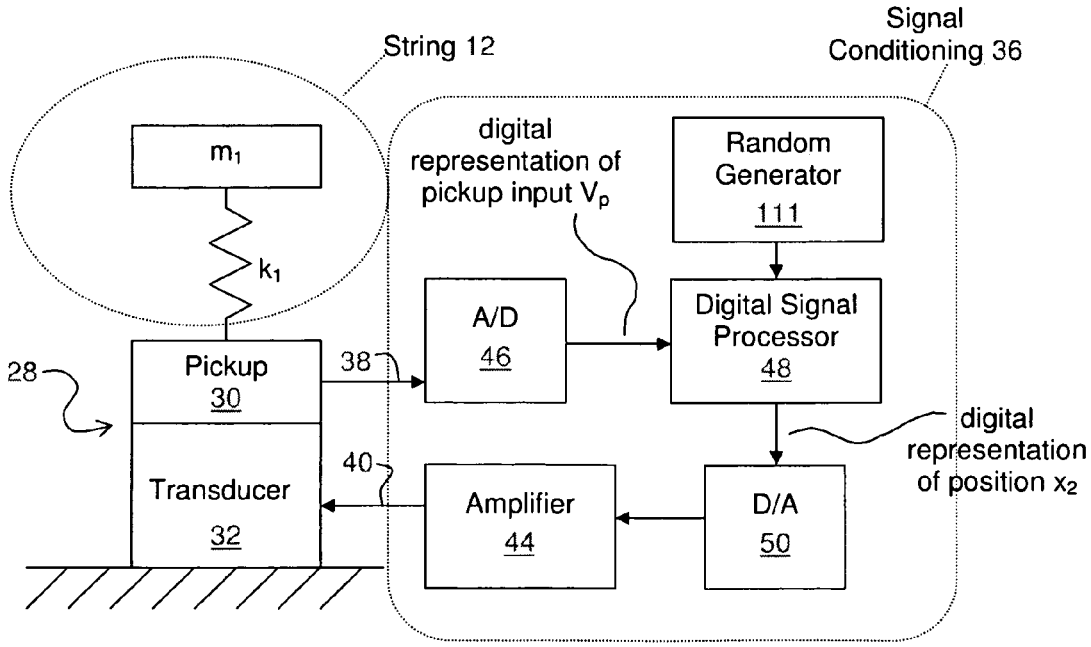
FIG. 26 is a schematic diagram of a modified version of FIG. 7 that includes a randomizing input.

Referring now to FIG. 26, random number generator 111 may be added to signal conditioning system 36 to avoid or reduce this problem. Random number generator 111 may provide random values, for example within a preset range, that are used by digital signal processor 48 to alter the timing of signal conditioning signal 40 that drives transducer 32. The random number can be applied to any of the calculated parameters; such as the instrument model values for spring constant $k_1$, natural frequency $f_1$, damping coefficient $b_1$, or just a gain on the magnitude of the signal output. The random number provided by generator 111 can be used at every clock cycle, or only once per fundamental period of vibration of string 12.

Figure 27:
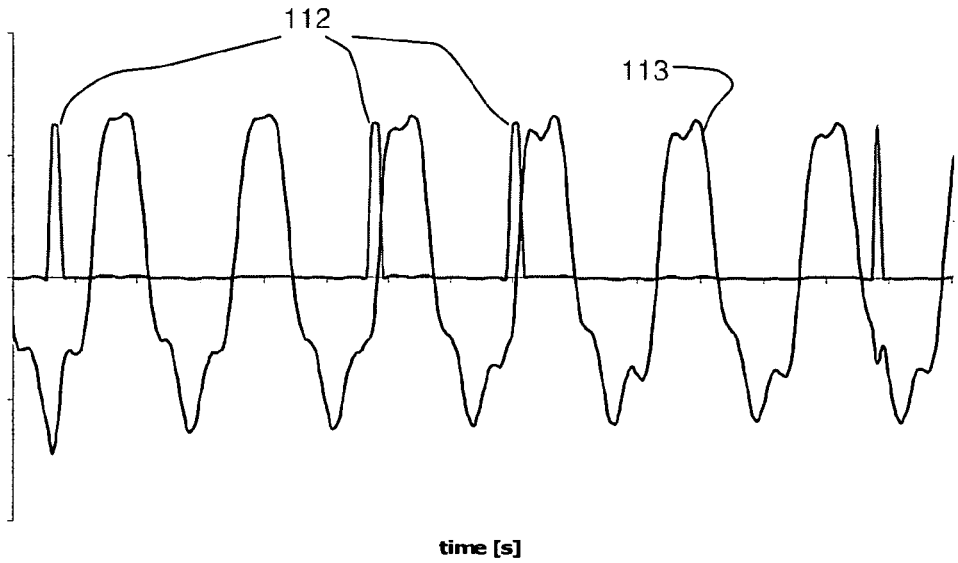
FIG. 27 is string response graph illustrating the effects of random inputs to the musical bridge.

Referring now also to FIG. 27, the random number from generator 111 can also be used to provide a pulse output from digital signal processor 48 that is either on or off, depending on the value of random number. Pulses 112 represent the position of the top of musical instrument bridge 28, and are of constant peak magnitude but varying width and timing according to the random number generator 111. Curve 113 represents the force exerted by the string 12 on the top of bridge assembly 28 in response to the pulsing of bridge assembly 28. While the fundamental vibrating period of string 12 remains essentially constant, the wave shape of curve 113, and therefore its harmonic content, varies significantly from cycle to cycle.

The random generator 111 in FIG. 26 can also be a user-defined algorithm that modifies the signal processing output periodically so that exact duplication of string vibrations is eliminated. This randomizing function can also be under the player's control in real time, such as by altering the gain effect of random number generator 111 or adjusting the repetition time of a preset algorithm.

Figure 28:
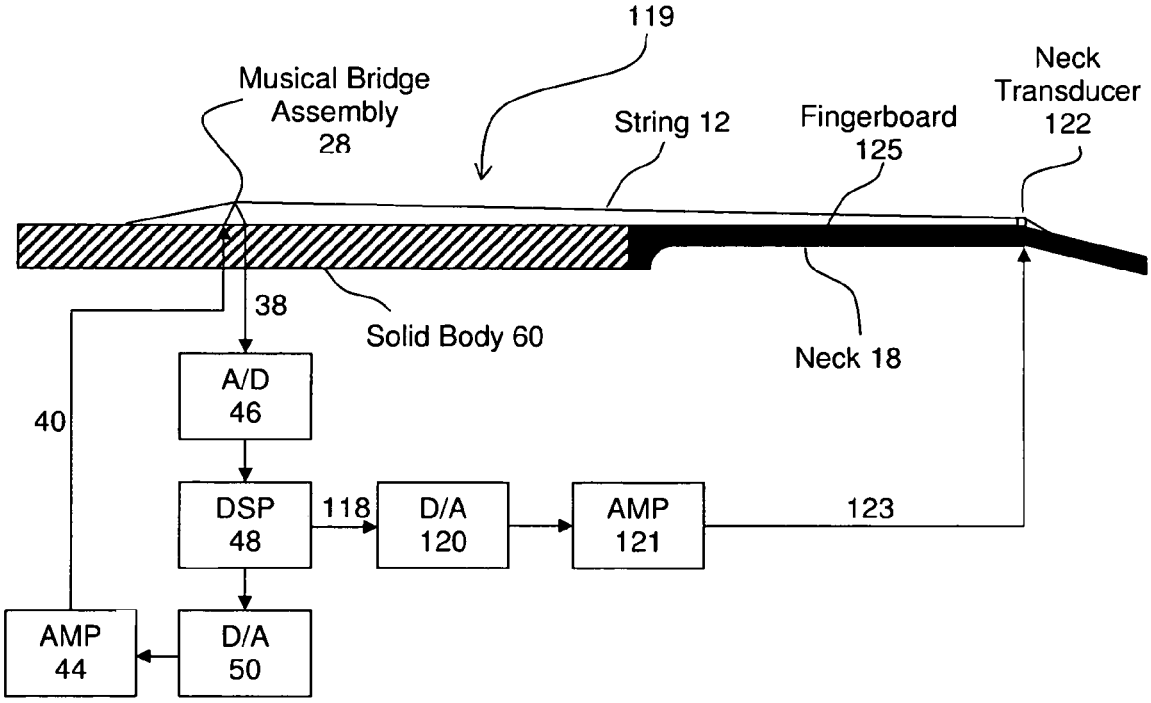
FIG. 28 is a block diagram of an alternate solid body guitar with multiple transducer locations.

Referring now to FIG. 28, in an alternate embodiment, a cross section for solid body electric guitar 119 is shown which includes solid body 60, musical instrument bridge 28, string 12, neck 18 and neck transducer 122. Neck transducer 122 is similar to transducer 32 in bridge assembly 28, except as shown it is associated with neck 18 and may be, for example, coupled to the nut which in turn supports the opposite end of string 12. Pickup output 38 may be applied to A/D converter 46, DSP 48 and D/A converter 50. D/A converter 50 provides a signal to amplifier 44, which in turn provides conditioning signal 40 to drive transducer 32. Similarly, DSP 48 may provide second output signal 118 to D/A 120 and amplifier 121, which provides output signal 123 to drive neck transducer 122.

Figure 29:
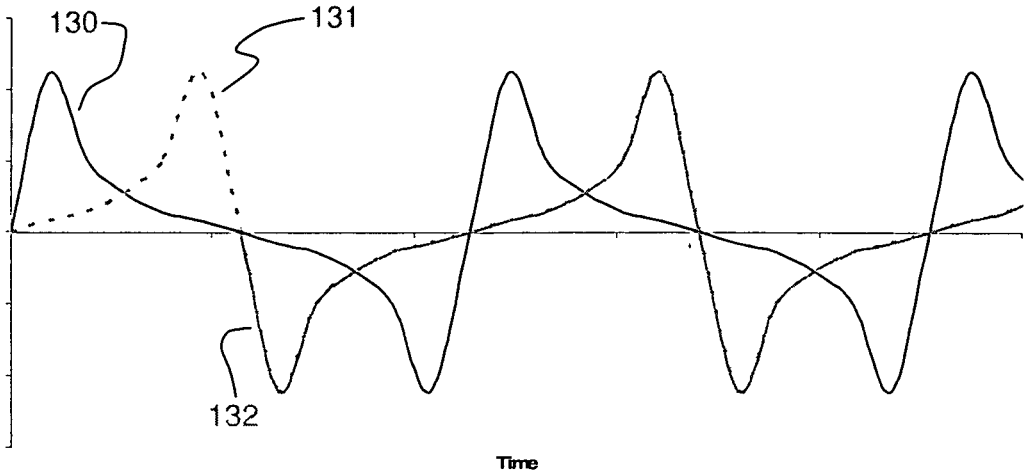
FIG. 29 is a string response graph illustrating a method to calculate forces at one location by sensing forces at a second location.

Referring now also to FIG. 29, the force of string 12 acting on the top of musical instrument bridge 28 is represented by curve 130. This example shows the fundamental frequency of string 12 and five harmonics. The force of string 12 acting on neck transducer 122 is represented by dashed curve 131. DSP 48 may use the signals represented by dashed curve 131 to calculate the desired response signal to apply to neck transducer 122, e.g. by calculating the fundamental harmonic of the vibration of string 12.

However pickup transducer 30 on bridge assembly 28, shown for example in FIG. 7, to estimate the forces at the nut or neck transducer 122 in FIG. 28. String 12 can be thought of as a traveling wave moving back and forth; in the case of an open string between the bridge and the nut. The distance between the bridge and nut represents a half wave of the fundamental frequency of string 12. As seen in FIG. 29, curve 131 is a reflection of curve 130 at the half cycle point. Curve 132 may be calculated by inverting the signal measured at the bridge pickup 30 and buffering it for one half cycle of the fundamental frequency of string 12. Calculated string forces at other locations along the neck can be similarly done by buffering the signal from pickup 30 for a fixed time related to the time it takes a traveling wave to go from the bridge to the desired location, and then blending that delayed signal with the present value of the pickup signal.

What is claimed is:

1. A method of making musical sounds from a musical instrument comprising:

providing at least one vibrating element;

providing at least one transducer between the at least one vibrating element and an instrument body;

sensing forces between the transducer and the vibrating element;

driving the transducer with feedback derived from the sensed forces; and, the transducer applying mechanical forces to the vibrating element to emulate musical sounds produced by a musical instrument having different musical characteristics.

2. The invention of claim 1 wherein applying the forces further comprises:

emulating an acoustic guitar.

3. The invention of claim 1 or 2 wherein applying the forces further comprises:

applying forces to the vibrating element with piezoelectric material.

4. The invention of claim 1 or 2 wherein applying the forces further comprises:

applying forces to the vibrating element with magnetic material.

5. The invention of claim 1 or 2 wherein sensing forces further comprises:

providing a piezoelectric pickup between the vibrating element and the applied forces.

6. The invention of claim 1 or 2 wherein sensing forces further comprises:

providing an electromagnetic pick up between the vibrating element and the applied forces.

7. The invention of claim 1 or 2 wherein the sensor senses acoustic forces applied to the musical instrument.

8. The invention of claim 1 or 2 wherein applying the forces further comprises:

applying forces to the vibrating element along more than one axis of vibration.

9. The invention of claim 1 wherein applying the forces further comprises:

altering the forces with a replaceable element controlling the emulation.

10. The invention of claim 1 or 2 wherein applying the forces further comprises:

altering the forces in response to user adjustments during operation of the musical instrument.

11. The invention of claim 1 or 2 wherein applying the forces further comprises:

controlling relative phase between the sensed and applied forces to avoid unwanted musical effects.

12. The invention of claim 11 wherein the unwanted musical effects include unwanted sustained oscillation.

13. The invention of claim 1 or 2 wherein applying the forces further comprises:

delaying applying the forces in response to the sensed forces to control the emulation.

14. The invention of claim 13 wherein delaying altering the forces further comprises:

determining a frequency characteristic of the sensed forces; and delaying applying altering forces in response to the frequency characteristic.

15. The invention of claim 14 wherein the frequency characteristic is a fundamental period of the vibrations of the vibrating element.

16. The invention of claim 1 or 2 further comprising:

determining a fundamental frequency of the vibrations of the vibrating element from the sensed forces; and delaying applying the forces to the vibrating element in accordance with the determined fundamental frequency.

17. The invention of claim 1 or 2 further comprising:

digitally processing the sensed forces; and modifying the applied forces to reduce unwanted sustained oscillation.

18. The invention of claim 17 wherein modifying the applied forces further comprises:

altering a characteristic of a waveform of the applied forces to reduce unwanted sustained oscillation.

19. The invention of claim 17 wherein modifying the applied forces further comprises:

modifying the applied forces in response to a random number generation.

20. The invention of claim 17 wherein modifying the applied forces further comprises:

modifying the applied forces in response to user input during playing of the musical instrument by the user.

21. A stringed musical instrument comprising:

at least one vibrating element;

at least one transducer between the at least one vibrating element and an instrument body;

a sensor for sensing mechanical forces between a vibrating element of the musical instrument and the transducer;

the transducer for applying mechanical forces to the vibrating element in response to the sensed forces; and, wherein the applied forces enable emulation of musical sounds produced by a musical instrument having different musical characteristics.

22. The musical instrument of claim 21 wherein the sensor is a piezoelectric sensor having an electrical output operable to sense forces.

23. The musical instrument of claim 22 wherein the transducer is a piezoelectric transducer having an electrical input operable to alter forces.

24. The musical instrument of claim 23 wherein an electrical feedback signal derived from the piezoelectric sensor drives the piezoelectric transducer.

* * * * *